US005579889A

United States Patent [19]

Maag et al.

[11] Patent Number: 5,579,889

[45] Date of Patent: Dec. 3, 1996

[54] DEVICE FOR PROCESSING PRINTED PRODUCTS

[75] Inventors: Urs Maag, Muehletal; Heinz Linder, Zofingen, both of Switzerland

[73] Assignee: GRAPHA-Holding AG, Hergiswil, Switzerland

[21] Appl. No.: 211,305

[22] PCT Filed: Jul. 7, 1993

[86] PCT No.: PCT/CH93/00174

§ 371 Date: Mar. 22, 1994

§ 102(e) Date: Mar. 22, 1994

[87] PCT Pub. No.: WO94/02398

PCT Pub. Date: Feb. 3, 1994

[30] Foreign Application Priority Data

Jul. 22, 1992 [CH] Switzerland ..... 2 306/92

[51] Int. Cl.[6] ..... B65G 1/00

[52] U.S. Cl. ..... 198/347.3; 198/347.4

[58] Field of Search ..... 198/346.2, 347.2, 198/347.3, 347.4

[56] References Cited

FOREIGN PATENT DOCUMENTS

| | | |
|---|---|---|
| 0229888A2 | 7/1987 | European Pat. Off. . |
| 0272398A1 | 6/1988 | European Pat. Off. . |
| 0300179A1 | 1/1989 | European Pat. Off. . |
| 0329602A2 | 8/1989 | European Pat. Off. . |
| 0560680A1 | 9/1993 | European Pat. Off. . |
| 2634216 | 2/1978 | Germany . |
| 3304219A1 | 10/1983 | Germany . |
| 3532403A1 | 4/1986 | Germany . |
| 2135660 | 9/1984 | United Kingdom . |
| 2144108 | 2/1985 | United Kingdom . |

*Primary Examiner*—D. Glenn Dayoan
*Attorney, Agent, or Firm*—Spencer & Frank

[57] ABSTRACT

Printed products are transported on a transport path to a product storage apparatus disposed laterally of the transport path by a curved transport segment and are transported from the product storage apparatus to the next processing station on a straight removal segment disposed approximately at a right angle to the transport path.

5 Claims, 1 Drawing Sheet

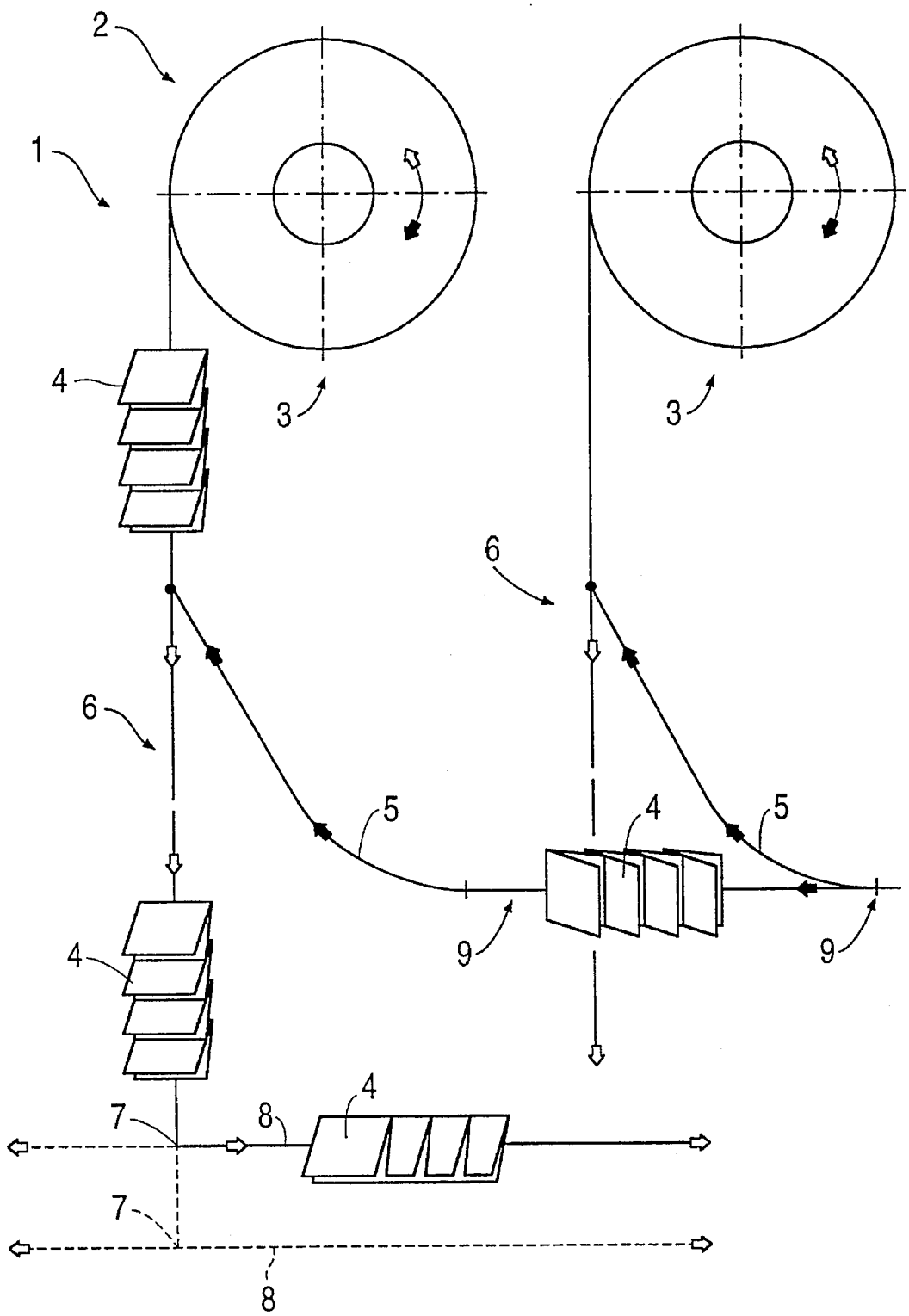
2
1
4
3
3
6
6
5
4
5
9
9
4
4
7
8
7
8

DEVICE FOR PROCESSING PRINTED PRODUCTS

BACKGROUND OF THE INVENTION

The invention relates to a device for processing printed products into newspapers, magazines, brochures or the like, wherein a product storage apparatus is disposed upstream of a processing station and includes at least one storage unit; and a charging segment is provided for transporting an imbricated stream of printed products along a transport path to the product storage apparatus for charging the at least one storage unit, the product storage apparatus being disposed laterally of the transport path and the charging segment including a curved course to effect a change of direction of the printed products from the transport path toward the laterally disposed product storage apparatus.

Charging the product storage apparatuses is effected via an output station downstream of a printing mechanism, at which the printed products are transferred to an imbricated formation from a conveyor and subsequently transported to the product storage apparatus. On this path the imbricated stream is typically turned so that it can be further processed after leaving the product storage apparatus.

Up to now, removal of the printed products from the product storage apparatus in imbricated formation was effected via a common transport segment forming a part of the transport path in front of the product storage apparatus and including a change in direction, and lead via direction changers to receiving stations in which the imbricated stream was taken over by a conveyor.

Because of the change in direction in the transport segment, this removal can often not take place free from friction and without the elimination of disturbances in the imbricated stream.

Furthermore, because of product paths that cross in front of the receiving stations, optimum charging of the latter from the product storage apparatus cannot take place.

At the same time, the transport of the printed products after removal from the product storage apparatus is effected with a so-called auxiliary conveyor, and the configuration of the receiving station is associated with a relatively high equipment expenditure.

SUMMARY OF THE INVENTION

It is therefore an object of the present invention to create a device of the above-mentioned type, by means of which interruptions that can be traced back to the conveyor flow are excluded to the fullest extent, optimum utilization is achieved and the mechanical expenditures can be decreased considerably.

The above and other objects are accomplished in the context of device for processing printed products as first described above wherein according to the invention there is provided a removal segment for removing printed products from the at least one storage unit and conveying them to the processing station, the removal segment being straight and disposed approximately at a right angle to the transport path.

A reliable removal of the printed products from the product storage apparatus, economical processing and simple design of the device are all thereby accomplished.

Particularly when one or a plurality of windings is used as the product storage apparatus(es), through which printed products pressed against each other experience a relatively strong, mutual adherence during winding, it is particularly advantageous when the printed products are not guided via a change in direction on the way to further processing.

The device of the invention proves particularly advantageous when the end of the removal segment disposed upstream during removal discharges into an approximately rectangular conveying device.

In an advantageous manner a conveying device is associated with each storage unit of the product storage apparatus, so that a plurality of storage units can be simultaneously evacuated.

It is recommended to dispose the conveying devices approximately one above the other so that each removal process can take place without disturbances.

The conveying devices, for example configured as a conveyor belt, can preferably alternatively be configured to be driven toward either of two directions, permitting selective charging of feeders or other further-processing stations.

The invention is described below by way of an example illustrated in the drawing figure.

BRIEF DESCRIPTION OF THE DRAWINGS

The single figure of the drawing schematically illustrates the device of the invention by way of an exemplary embodiment.

DETAILED DESCRIPTION OF THE PREFERRED EMBODIMENT

The device 1 shown in the single figure of the drawing exhibits a product storage apparatus 2 comprising two storage units 3, in the present case two wound, imbricated formations of printed products 4.

The charging of windings known per se as storage units 2 is effected from the printing mechanism via an output station not represented, at which station the printed products 4 are set into their further progressive motion in imbricated formation.

Conventionally the imbricated stream leaving the printing station is turned on transport path 9 toward the storage unit so that, after leaving the latter, it is prepared for further processing. As shown, printed product 4 travels via transport path 9 indicated by the dark arrows into the storage units, transport path 9 having a curve-type transport segment 5 that insignificantly interferes with the regularity of the printed products transported superposed loosely on top of one another. Removal from product storage apparatus 2, that is, the individual storage units 3, is effected in the formation of the transported printed products 4 via a straight removal segment toward a next processing station 7, which segment prevents a change in the formation of the imbricated stream to be unwound.

Even when the next processing station 7 is (merely) a device for changing the conveying direction and/or the imbricated formation, no additional exertion of influence on the imbricated stream is required. As shown, a conveyor device 8 is disposed approximately at a right angle to removal segment 6, which rearranges the supply stream of printed products 4 so that they are transported in succession, for example, to a feeder (not visible), with the lateral openings of the printed products.

The device 1 in accordance with the invention permits a plurality of storage units 3 to be evacuated simultaneously in that a conveyor device 8 is associated with each storage unit 3. Therefore, a crossing of printed products 4 or the use of a common transport path 9 by a plurality of printed product lines during the removal process is avoided.

Alternatively, a storage unit 3 can also be allocated different conveyor devices 8. As indicated by the broken lines representing conveyor segments 5 and 6, a direction changer can be used to change the conveyor paths.

As shown, conveyor devices 8 can be configured as belts and can be drive-controlled in two different directions.

As is evident, the possibility also results of disposing conveyor devices 8 on top of one another or offset with respect to one another at different levels so that the conveying flow can be organized without disruption.

We claim:

1. In a device for processing printed products into one of newspapers, magazines, brochures and similar products, a combination comprising:

a product storage apparatus disposed upstream of a processing station and comprising a plurality of storage unit;

a charging segment including a transport path along which an imbricated stream of printed products are transported to the product storage apparatus for charging the plurality of storage unit, the product storage apparatus being disposed laterally of the transport path and the charging segment including a curved course to effect a change of direction of the printed products from the transport path toward the laterally disposed product storage apparatus;

a plurality of removal segments each being allocated to a respective one of the storage units for removing printed products from the respective storage unit and conveying them to the processing station, the removal segments being straight and disposed approximately at a right angle to the transport path; and a plurality of conveyor devices each being allocated to a respective one of the removal segments and disposed approximately at a right angle to the respective removal segment and approximately parallel to the transport path, wherein each removal segment has an end that discharges into a respective one of the conveyor devices.

2. The device as defined in claim 1, wherein the storage units are connectable to different ones of the conveyor devices.

3. The device as defined in claim 1, wherein the conveyor devices are drivable in two directions.

4. The device as defined in claim 1, wherein the conveyor devices are disposed one above the other.

5. The device as defined in claim 1, wherein the storage units comprise winding devices.

* * * * *